United States Patent [19]

Suchowerskyj et al.

[11] 4,284,050

[45] Aug. 18, 1981

[54] APPARATUS FOR CONTROLLING THE MIXTURE COMPOSITION IN AN INTERNAL COMBUSTION ENGINE

[75] Inventors: Wadym Suchowerskyj, Schwieberdingen; Peter Werner, Wiernsheim; Hans Schnürle, Waldheim; Werner Möhrle, Stuttgart; Urlich Drews, Vaihingen-Pulverdingen, all of Fed. Rep. of Germany

[73] Assignee: Robert Bosch GmbH, Stuttgart, Fed. Rep. of Germany

[21] Appl. No.: 87,899

[22] Filed: Oct. 24, 1979

[30] Foreign Application Priority Data

Oct. 25, 1978 [DE] Fed. Rep. of Germany ..... 2846386

[51] Int. Cl.[3] ..... F02M 51/00

[52] U.S. Cl. ..... 123/483; 123/489

[58] Field of Search ..... 123/483, 484, 489

[56] References Cited

U.S. PATENT DOCUMENTS

| | | | |
|---|---|---|---|
| 3,998,189 | 12/1976 | Aoki | 123/489 X |
| 4,048,479 | 9/1977 | Rivere | 123/483 X |
| 4,133,320 | 1/1979 | Bianchi et al. | 123/489 X |
| 4,145,999 | 3/1979 | Aoki | 123/489 |
| 4,172,433 | 10/1979 | Bianchi et al. | 123/489 X |
| 4,178,884 | 12/1979 | Norimatsu et al. | 123/489 |
| 4,205,378 | 5/1980 | Ward | 123/489 X |
| 4,221,194 | 9/1980 | Wright | 123/489 X |

*Primary Examiner*—Tony M. Argenbright

*Attorney, Agent, or Firm*—Edwin E. Greigg

[57] ABSTRACT

An apparatus for the open-loop or closed-loop control of the composition of the mixture desired in the combustion chamber of an internal combustion engine, which includes an exhaust gas sensor whose output signal together with other operational parameters, determines the mixture composition. The essential component of the apparatus is a storage unit with which charging and discharging sources controllable in accordance with the sensor signal are associated, wherein the magnitude of the charging and discharging signal is dependent on operational parameters. The storage unit may comprise a capacitor or a resistor-capacitor combination having one terminal connected to ground and another terminal efficiently connected with an operational voltage connection, so as to have in this manner an unequivocal association with a fixed potential.

27 Claims, 8 Drawing Figures

APPARATUS FOR CONTROLLING THE MIXTURE COMPOSITION IN AN INTERNAL COMBUSTION ENGINE

BACKGROUND OF THE INVENTION

The invention applies to internal combustion engines, and, in particular, to fuel metering apparatuses having an oxygen measuring sensor in the exhaust flow of the internal combustion engine.

In such apparatuses, the fuel metering is effected in accordance with the particular concentration of oxygen in the exhaust in such a manner that, to the greatest possible extent, a stoichiometric ratio of air and fuel (in internal combustion engines with externally-supplied ignition) is available in the combustion chambers.

The control circuits having these oxygen sensors must now contain an integrator which enables the generation, from the signals of the oxygen sensor which are generated as pulses, of a variable direct voltage affecting fuel metering. The output signal of an oxygen sensor in the exhaust is pulse-like because the composition of the exhaust gas varies in accordance with the extent to which the various output valves are open at a particular time. Furthermore, an integrator in the control circuit has the advantage that longer-lasting deviations lead all the more to a strong counter-control process, and thus the desired mixture composition can be attained all the more rapidly.

In a known apparatus for detoxifying the exhaust gas of internal combustion engines German Offenlegungsschrift (laid-open application) No. 2 251 167, the integrator is embodied as an operational amplifier which is counter-coupled capacitively. It has now been determined that the output signal of this integrator does not possess the necessary and desired constancy over a relatively long period of time such as is particularly desirable when, during certain operational states, such as full load, overrunning or acceleration, the mixture control intended for producing cleaner exhaust gas is suspended, more or less briefly, for the sake of achieving the desired driving behavior.

Finally, in the known apparatus, a systematic charging and discharging of the integrator presents problems; that is, it is attainable only at very great expense in terms of circuit technology.

OBJECT AND SUMMARY OF THE INVENTION

It is the object of the invention to avoid these various disadvantages.

The apparatus according to the invention has the advantage, among others, over the period art in that a symmetrical control of the integrator slopes is possible for both running directions and this may be attained, in an appropriate layout, by means of a single signal, which may be dependent, for example, an rpm. If both the charging and the discharging source are blocked, then the storage unit contents remain at constant potential, and after the expiration of the open-loop control state, the closed-loop control process can begin on the basis of the storage unit value which had been valid previously.

This apparatus is particularly advantageous when the charging or discharging signals of the storage unit are dependent on operational parameters such as rpm and/or the air flow through the intake manifold. Where the storage unit is embodied as a capacitor or a capacitor-resistor combination, voltage control can be attained in an efficient and simple fashion by embodying the charging and discharging sources as so-called "current mirrors". As used herein, a current mirror is a circuit having the property of drawing a current which is in a predetermined relationship to another current fed to the current mirror, or of producing a current which is in a predetermined relationship to another current drawn from the current mirror.

The invention will be better understood and further objects and advantages thereof will become more apparent from the ensuing detailed description of preferred embodiments taken in conjunction with the drawings.

DESCRIPTION OF THE PREFERRED EMBODIMENTS

A fuel injection system and an engine with externally supplied ignition offer a particularly good opportunity for intervention in order to control the exhaust gas composition. Naturally, in principle, such a control apparatus can also be used in fuel metering provided by carburetors. Furthermore, exhaust gas control systems are possible in principle in internal combustion engines having auto-ignition (that is, Diesel engines), even when an engine of this kind is, as a rule, operated with excess air.

Figure 1:
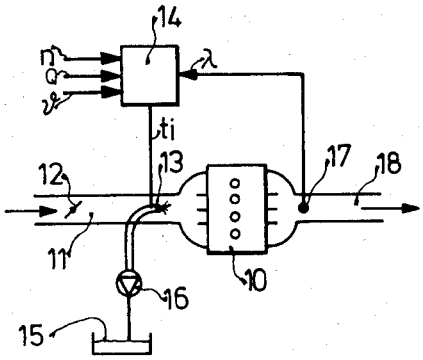
FIG. 1 is a simplified schematic diagram of a fuel injection system in an internal combustion engine having externally-supplied ignition.

The engine in FIG. 1 is designated by reference numeral 10. A throttle valve 12 and an electromagnetic injection valve 13 are located in an intake manifold 11, and the injection valve 13 receives its electrical trigger signals from a control device 14 and receives fuel from a fuel container 15 via a fuel pump 16. The input variables for the control device 14 are signals for the rpm (n), for the air throughput quantity (Q) in the intake manifold, for the engine temperature ($\theta$) and for the composition of the exhaust gas (λ). The exhaust gas composition is detected via an oxygen measuring sensor 17 in the exhaust pipe 18 of the engine 10.

In the control device 14, injection signals of duration ti are generated in accordance with the various operational parameters and the electromagnetic injection valve 13 is exposed to these injection signals.

The (very simple) illustration of FIG. 1 makes clear the necessarily long delay time associated with the output signal of the oxygen sensor in signaling a change in mixture composition. This is because the engine must complete a full work cycle before a change in mixture composition can make itself noticeable at the exhaust gas sensor. For this reason alone, it is useful to include an integrating element in the control circuit of the oxygen sensor, as is already known in the prior art.

Figure 2:
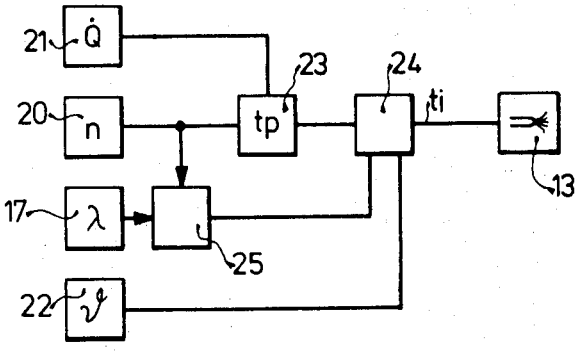
FIG. 2 is a schematic block diagram of the electrical portion of a fuel injection system.

In FIG. 2, the control device 14 of FIG. 1 is illustrated in block-diagram form, together with the transducers for the operational parameters for rpm, 20; air throughput in the intake manifold, 21; and temperature, 22; and with the electromagnetic injection valve 13. The control device comprises a timing circuit 23, in which a crude injection time—that is, injection pulses of duration tp—is determined on the basis of rpm and air throughput in the intake manifold. On the output side, the timing circuit 23 is connected with a correction stage 24. There, the injection pulses of duration tp are corrected in accordance with the temperature and the composition of the exhaust gas, and then they are supplied as injection pulses of duration ti to the injection valve 13.

A λ control stage is designated by reference numeral 25. On the basis of the output signal of the oxygen sensor 17 in the exhaust pipe 18 of the engine 10 and under the influence of rpm, the λ control stage 25 furnishes a variable by means of which the crude injection signal tp is corrected in the correction stage 24.

Figure 3:
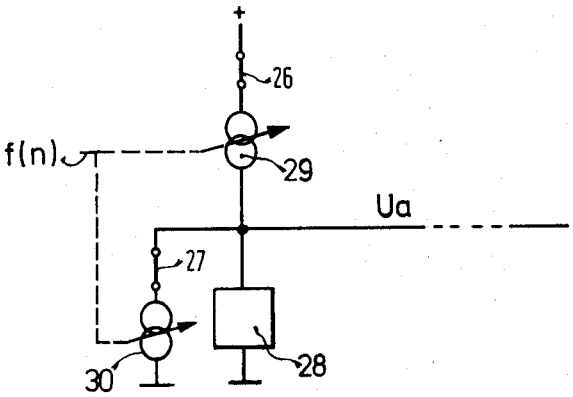
FIG. 3 is a simplified schematic diagram of a λ control stage.

FIG. 3 shows in schematic form the structure of the control stage 25 of FIG. 2. The primary component is a storage unit 28, which has associated with it a charging source 29 and a discharging source 30. One of the switches 26 and 27, respectively, is associated with each of these sources 29 and 30, which are closed or opened in accordance with the composition of the exhaust gas. Thus, for example, switch 26 opens when the mixture is too lean; this means that when the mixture is too rich, the contents of the storage unit 28 are reduced, while conversely when the mixture is too lean, the contents of the storage unit increase.

The charging and discharging sources, 29 and 30, are controllable in accordance with one operational parameter. It is efficient to have the sources be dependent on rpm; however, if need be, a dependence on air flow, or a mixed dependence on two or more operational parameters, is also possible.

Figure 4:
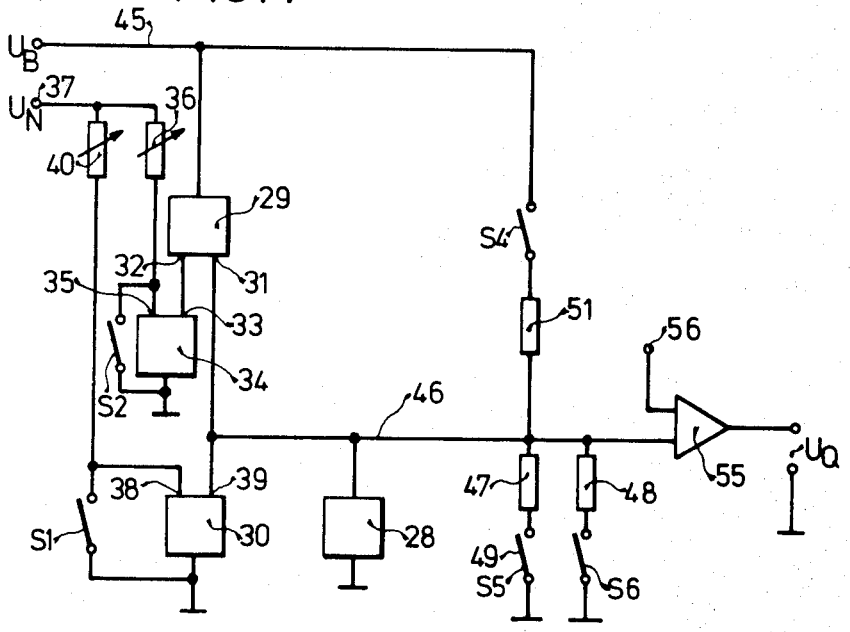
FIG. 4 is a more detailed schematic diagram of the λ control stage of FIG. 3.

In the form of a block circuit diagram, FIG. 4 represents one possible form of embodiment of the circuit layout of FIG. 3, with additional possibilities for intervention in the output signal of the control circuit 25 being indicated.

Parallel to the storage unit 28 in the circuit of FIG. 4 is the discharging current source 30 embodied in the form of a current mirror. In series with this parallel arrangement is the charging current source 29, which is also embodied as a current mirror. The current mirror 29 has an output 31 and an input 32. While the output 31 furnishes the charging current for the storage unit 28, the input 32 is carried to an output 33 of a further current mirror 34, whose input 35 is in turn connected via an adjustable resistor 36 with an input contact 37 at which a voltage $U_N$, which is dependent on one or more operational parameters, is impressed. In a corresponding manner, an input 38 of the current mirror 30, into whose output 39 the discharging current of the storage unit 28 is delivered, is connected via an adjustable resistor 40 with the input contact 37. The inputs 38 and 35 of the current mirrors 30 and 34 can be short-circuited to ground by means of switches S1 and S2. Thus the switch S2 is closed when the mixture is excessively rich, and the switch S1 is closed when the mixture is too lean.

The current mirror 29 is connected with the positive lead 45, and the current mirrors 34 and 30 are connected with the negative lead.

The line connecting the current mirrors 29, 30 and the storage unit 28 is designated by reference numeral 46. From here, a further series circuit made up of a resistor 47 and a normally open switch S5, and a series circuit made up of a resistor 48 and a normally open switch S6, are connected to ground. The connecting line 46 is also connected via a resistor 51 and a normally open switch S4, with the positive lead 45. The connecting line 46 leads to a first input of an amplifier 55, whose second input is coupled with a connection point 56 for an acceleration signal. A voltage $U_Q$ between the output of the amplifier 55 and ground is delivered, in accordance with FIG. 2, to the correction stage 24.

As previously stated, current mirrors have the property of drawing a current which is in a predetermined relationship to the current which is fed into them, or of producing a current which is in a predetermined relationship to the current which is drawn out of them. This provides a simple means of voltage control of currents. If, for example, when switch S1 is opened a predetermined current derived from the potential at the input contact 37 and from the resistance value of the resistor 40 is delivered to the current mirror 30, then this current mirror 30 draws a current via its output 39 which is varied by a fixed factor. By means of voltage control at the input contact 37, a variation of the current at the output 39 of the current mirror 30 is thus possible. If the switch S1 is closed, then no further current proceeds via the input 38 into the current mirror 30 and the output 39 is accordingly also free of current; this means, in turn, that the storage unit 28 is not discharged by the current mirror 30.

With the aid of switches S2 and S1, charging and discharging of the storage unit 28 is possible, as well as retention of a constant charge when both switches S1 and S2 are open. The charging and discharging currents can be selected in accordance with the resistance values of the adjustable resistors 36 and 40. In a preferred exemplary embodiment of the invention, these currents are identical, in order to attain symmetrical charging and discharging of the storage unit 28.

If the switches S1, S2, S4 and S5 or S6 are closed, then a fixed potential is established on the connecting line 46 which is derived from the particular voltage divider ratio present at the time. In this manner, constant potentials are attained on the line 46. This behavior mode is desired in such states as full-load, overrunning, low oil or water temperature, and operational unreadiness on the part of the oxygen sensor 17. In the same manner, an acceleration on the part of the vehicle operator should be transformed into a corresponding fuel metering signal with as little delay as possible. For this reason, an acceleration signal is supplied directly to the amplifier 55 via the input 56, with the result that the output signal of this amplifier 55 becomes maximal, independently of the potential value on the connecting line 46.

The following table shows the behavior of the output voltage $U_Q$ in accordance with the sensor signal, with the positions of the various switches, and with the acceleration signal at input 56.

| Mixture | lean | rich | arbitrary | arbitrary | arbitrary |
|---|---|---|---|---|---|
| S1 | 1 | 0 | 1 | 1 | x |

-continued

| Mixture | lean | rich | arbitrary | arbitrary | arbitrary |
|---|---|---|---|---|---|
| S2 | 0 | 1 | 1 | 1 | x |
| S4 | 0 | 0 | 1 | 1 | x |
| S5 | 0 | 0 | 1 | 0 | x |
| S6 | 0 | 0 | 0 | 1 | x |
| 56 (Acceleration signal) | 0 | 0 | 0 | 0 | 1 |
| $U_Q$ | ↗ | ↘ | ⎍ | ⎍ | ⎍ |

0 = switch open
1 = switch closed
x = no effect

The output signal of the amplifier stage 55 varies steadily when switches S4, S5, S6 are open and when there is no acceleration signal present at input 56, while the direction, positive or negative, in which the variation occurs is dependent on the composition of the fuel-air mixture. Under the special operational conditions (that is, when switches S4 and S5, or S4 and S6 are closed), the output signal is a fixedly oriented, constant value. In the presence of an acceleration signal, $U_Q$ becomes maximal, independently of the state of all the switches and independently of the oxygen sensor signal.

Figure 5:
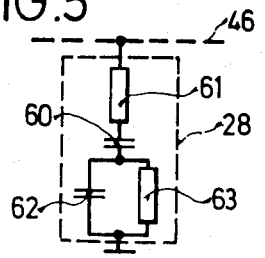
FIG. 5 is a schematic diatram of a storage unit which can be used in the control stages of FIGS. 3 and 4.

FIG. 5 shows one example of a circuit for the storage unit 28 of FIGS. 3 and 4. What is essential is a capacitor 60 as the storing or integrating element, which is connected in series with a resistor 61, and a parallel circuit made up of a capacitor 62 and a resistor 63. This resistor-capacitor combination exhibits a particular behavior with respect to time which has proved to be efficient for a particular engine type.

Figure 6A:
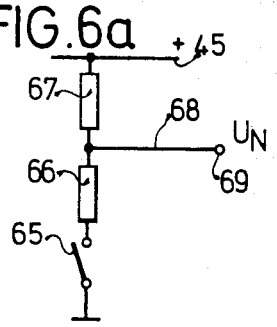
FIGS. 6*a* and 6*b* are schematic diagrams of respective circuits for generating an rpm-dependent voltage signal; and, finally.
Figure 6B:
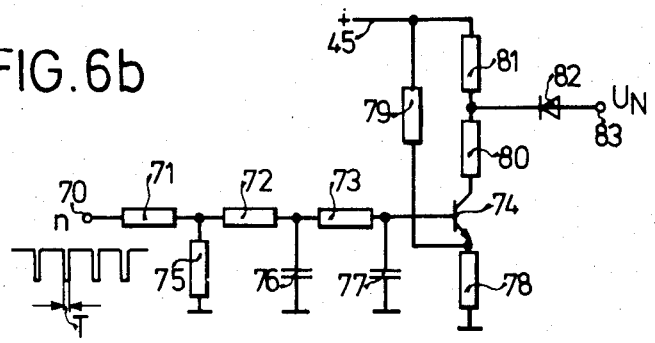

The illustrations of FIGS. 6*a* and 6*b* show respective circuits for generating an rpm-dependent signal which is fed into the λ control stage via the input 37 in the circuit of FIG. 4.

The switching diagram of FIG. 6*a* shows an idling switch 65, which is closed during idling in accordance with rpm. The idling switch 65 is in series with two resistors 66 and 67 between the positive lead 45 and ground, with a line 68 leading to the output terminal 69 connected to the common junction of the two resistors 66 and 67. When this circuit is used for generating an rpm-dependent signal, terminal 69 of FIG. 6*a* and terminal 37 of FIG. 4 are connected with each other. Then the potential which is produced at terminal 37 of the circuit of FIG. 4 is dependent on the position of the switch 65.

As an alternative to the embodiment of FIG. 6*a*, a circuit in accordance with FIG. 6*b* can be used, which receives information relating to the engine rpm and derives from this an rpm-dependent voltage $U_N$. The input for rpm pulses is a terminal 70, from which a series circuit made up of three resistors 71, 72 and 73 leads to the base of an NPN transistor 74. The connection points of the individual resistors 71, 72, 73 are connected to ground through a resistor 75, a capacitor 76, and a capacitor 77, respectively. The emitter of the transistor 74 is connected to ground through a resistor 78 and is also connected with the positive lead 45 through a resistor 79. The collector of the transistor 74 is connected to the positive lead 45, through a series circuit of two resistors 80 and 81 and the connection point of the two resistors 80 and 81 is connected through a diode 82 with an output terminal 83.

Negative pulses of constant duration T, whose frequency is proportional to the rpm, thus proceed, in the layout of FIG. 6*b*, through a low pass filter circuit to an amplifier stage comprising the transistor 74, and this amplifier stage, within a fixed rpm range, delivers a voltage proportional to the rpm. The speed with which the control voltage $U_Q$ varies increases in approximately linear fashion, within this range, with the engine rpm, which as a result permits the attainment of good values for exhaust gas composition.

Figure 7:
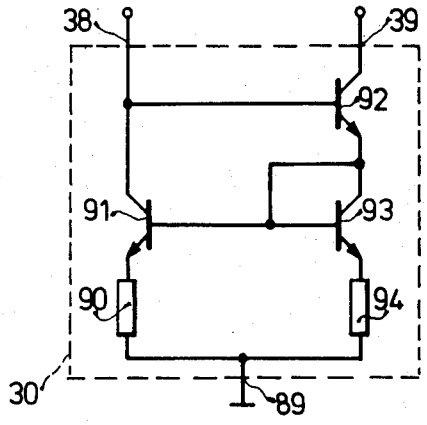
FIGS. 7 and 8 are schematic diagrams of respective "current mirror" circuits.
Figure 8:
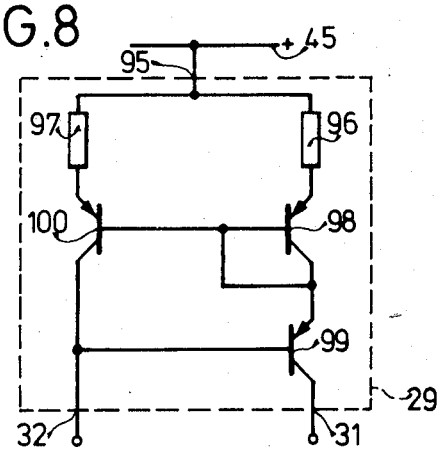

Examples of possible embodiments for the current mirrors 29, 30 and 34 are shown in FIGS. 7 and 8.

The current mirror 30 in FIG. 7 has one input 38 and one output 39, as well as a terminal 89 connected to ground, which can be seen in FIG. 4. Between the input 38 and terminal 89, there is a series circuit made up of resistor 90 and the collector-emitter path of an NPN transistor 91. In corresponding fashion, a series circuit made up of two collector-emitter paths of two NPN transistors 92 and 93 and a resistor 94 is disposed between output 39 and terminal 89. The base of the transistor 92 is connected with the input 38. The bases of the two transistors 91 and 93 are connected with one another and are connected to the connection point of the two transistors 92 and 93.

The current mirror 30 shown in FIG. 7 is laid out as a current sink. It acts in such a manner that the current in output 39 is in a certain relationship with the current at input 38. Now, as shown in FIG. 4, the current to input 38 can be voltage-controlled and in this manner a current is delivered into the output 39 which is likewise voltage-controlled.

FIG. 8 shows a current source 29, which is equivalent to that shown in FIG. 7. The current source 29 includes an output 31, an input 32, and a terminal 95 which is connected to the positive lead 45. The terminal 95 is connected through a resistor 96 to the emitter of another PNP transistor 100. The collector of the transistor 98 is connected to the emitter of a third PNP transistor 99, the collector of the transistor 100 is connected to the input 32, and the collector of the transistor 99 is connected to the output 31. The bases of the transistors 98 and 100 are coupled with one another and connected with the connection point of the transistors 98 and 99 as well, while the base of the transistor 99 is connected with the input 32. In this current mirror 29, the current of the output 31 aligns itself with the current of the input 32. Thus, in a manner corresponding to that of the circuit of FIG. 7, an output current can be voltage-controlled in the circuit of this FIG. 8.

Because of the relatively simple design of the charging and discharging current sources in the circuit layouts of FIGS. 3 and 4, the opportunity presents itself for an integration of the individual components.

The essential feature of the invention described above is that the integration capacitor, the resistor-capacitor combination, or the storage unit 28 in general is not located, as in the known prior art, in the counter-coupling branch of a reverse-coupled operational amplifier, but rather at an operational voltage connection for supply voltage. In the case described above, this is the negative pole of the supply voltage, on which all the other signal dimensions coming under consideration for control purposes are based, such as voltage sources for initial setting of a certain integrator state when the sensor is not operationally ready, or at full load or during overrunning. The combination of the capacitor with the controllable current sources or current mirrors, in the exemplary embodiment, for charging and discharging enables the symmetrical control of the integrator slopes for both operational directions by means of a single analog voltage, such as, in this case, an rpm-dependent voltage.

If both current sources are blocked at the same time, the voltage level of the integrator remains where it is, which is advantageous when the control is intended to be blocked in particular operational states and it is intended to return thereafter to the identical status of the fuel-air mixture.

The type of rpm control used in the example of the invention discussed above, that is, by means of an rpm-dependent direct voltage determined by the slope, has the following advantages over the means of rpm control through integrator synchronization as is known from the prior art:

1. The effect of the constant λ displacement time is, in desired fashion, dependent on rpm; that is, the displacement increases with increasing rpm.
2. The rpm control of the charging and discharging currents acts in a proportional manner for both steep and flat portions of the slope of the integrator voltage plotted over time. This is desired for adaptation purposes.
3. The realization of the rpm control circuit as an amplifier stage (FIG. 6*b*), with an upper and lower limit on the output voltage as a function of the rpm, makes possible the limitation of the adjustment range of the slopes and the selection of slopes in a particular rpm range.

The foregoing relates to preferred exemplary embodiments of the invention, it being understood that other embodiments and variants thereof are possible within the spirit and scope of the invention, the latter being defined by the appended claims.

What is claimed and desired to be secured by letters patent of the United States is:

1. In an apparatus for controlling the composition of a mixture delivered to a combustion chamber of an internal combustion engine which includes a plurality of operational parameter sensing means for controlling the quantity of fuel supplied to the engine as a function of said parameters, wherein said plurality of parameter sensing means includes an exhaust sensor, the improvement which comprises:

an electrically charged storage means for storing an electrical quantity;

charging source means, associated with said storage means and said plurality of operational parameter sensing means, for providing a charging current to charge said storage means, the initiation and duration of said charging current being controlled by said exhaust sensor, and the magnitude of said charging current being controlled by at least one of said operational parameter sensing means other than said exhaust sensor; and discharging source means, associated with said storage means and said plurality of operational parameter sensing means, for controlling a discharge current from said storage means to discharge said storage means, the initiation and duration of said discharge current being controlled by said exhaust sensor, and the magnitude of said discharge current being controlled by at least one of said operational parameter sensing means other than said exhaust sensing means.

2. An apparatus, as described in claim 1, wherein said exhaust sensor is an oxygen sensor.

3. An apparatus, as described in claim 1, wherein the magnitude of said charging current and the magnitude of said discharge current are controlled by the same at least one of said operational parameter sensing means other than said exhaust sensor, wherein the magnitudes of said charging and discharging currents are in a predetermined relationship to one another.

4. An apparatus, as described in claim 3, wherein said at least one of said operational parameter sensing means comprises a means for sensing engine rpm.

5. An apparatus, as described in claim 4, wherein said at least one of said operational parameter sensing means further comprises a means for sensing the quantity of air supplied to the engine.

6. An apparatus, as described in claim 3, wherein said at least one of said operational parameter sensing means comprises a means for sensing the quantity of air supplied to the engine.

7. An apparatus, as described in claim 1, wherein said at least one of said operational parameter sensing means controlling the magnitude of said charging current comprises a means for sensing engine rpm.

8. An apparatus, as described in claim 7, wherein said at least one of said operational parameter sensing means controlling the magnitude of said charging current further comprises a means for sensing the quantity of air supplied to the engine.

9. An apparatus, as described in claim 1, wherein said at least one of said operational parameter sensing means controlling the magnitude of said charging current comprises a means for sensing the quantity of air supplied to the engine.

10. An apparatus, as described in claim 1, wherein said at least one of said operational parameter sensing means controlling the magnitude of said discharge current comprises a means for sensing engine rpm.

11. An apparatus, as described in claim 10, wherein said at least one of said operational parameter sensing means controlling the magnitude of said discharging current further comprises a means for sensing the quantity of air supplied to the engine.

12. An apparatus, as described in claim 1, wherein said at least one of said operational parameter sensing means controlling the magnitude of said discharging current comprises a means for sensing the quantity of air supplied to the engine.

13. An apparatus, as described in claim 1, which further comprises control means for controlling the contents of said storage means to a predetermined value during an operational state of the engine.

14. An apparatus, as described in claim 13, wherein said operational state is a full-load operational state of the engine.

15. An apparatus, as described in claim 13, wherein said operational state is an overrunning operational state of the engine.

16. An apparatus, as described in claim 13, wherein said operational state is a a low oil operational state of the engine.

17. An apparatus, as described in claim 13, wherein said operational state is a low water temperature operational state of the engine.

18. An apparatus, as described in claim 13, wherein said operational state is an operational unreadiness condition of said exhaust sensor.

19. An apparatus, as described in claim 1, which further comprises:

signal processing means having a first input connected to said storage means and a second input; and control means for supplying a predeterminable signal to said second input of said signal processing means during an operational state of said engine, to thus simulate a changed value of the electrical quantity stored by said storage means.

20. An apparatus, as described in claim 19, wherein said operational state is an engine acceleration process.

21. An apparatus, as described in claim 1, wherein said storage means comprises a capacitor.

22. An apparatus, as described in claim 1, wherein said storage means comprises a resistor-capacitor combination.

23. An apparatus, as described in claim 1, wherein said charging source means comprises a current mirror.

24. An apparatus, as described in claim 1, wherein said discharging source means comprises a current mirror.

25. An apparatus, as described in claim 1, wherein said at least one of said operational parameter sensing means controlling the magnitude of said charging current comprises an engine rpm sensor for producing an output voltage signal having an upper limit and a lower limit, said output voltage signal being proportional to the engine rpm between said upper and lower limits.

26. An apparatus, as described in claim 1, wherein said at least one of said operational parameter sensing means controlling the magnitude of said discharging current comprises an engine rpm sensor for producing an output voltage signal having an upper limit and a lower limit, said output voltage signal being proportional to the engine rpm between said upper and lower limits.

27. An apparatus, as described in claim 1, wherein said at least one of said operational parameter sensing means controlling the magnitude of said charging current and said at least one of said operational parameter sensing means controlling the magnitude of said discharge current comprises an engine rpm sensor for producing an output voltage signal having an upper limit and a lower limit, said output voltage signal being proportional to the engine rpm between said upper and lower limits.

* * * * *